US005486303A

United States Patent [19]

Capeci et al.

[11] Patent Number: 5,486,303

[45] Date of Patent: Jan. 23, 1996

[54] PROCESS FOR MAKING HIGH DENSITY DETERGENT AGGLOMERATES USING AN ANHYDROUS POWDER ADDITIVE

[75] Inventors: Scott W. Capeci, North Bend; James W. Osborn, Cincinnati, both of Ohio; Adrian J. W. Angell, Strombeek-Bever; Paul van Dijk, Putte, both of Belgium

[73] Assignee: The Procter & Gamble Company, Cincinnati, Ohio

[21] Appl. No.: 283,131

[22] Filed: Aug. 3, 1994

Related U.S. Application Data

[63] Continuation-in-part of Ser. No. 113,572, Aug. 27, 1993, Pat. No. 5,366,652.

[51] Int. Cl.[6] ..... C11D 11/00; C11D 17/06

[52] U.S. Cl. ..... 252/89.1; 252/174; 252/135; 252/174.23; 264/117; 264/140

[58] Field of Search ..... 252/89.1, 90, 174, 252/174.23, 135; 264/117, 140

[56] References Cited

U.S. PATENT DOCUMENTS

| | | | |
|---|---|---|---|
| 3,758,671 | 9/1973 | Kandler et al. | 423/315 |
| 4,427,417 | 1/1984 | Porasik | 23/313 R |
| 4,487,710 | 12/1984 | Kaminsky | 252/546 |
| 4,664,950 | 5/1987 | Wixon | 427/214 |
| 4,738,793 | 4/1988 | Travill | 252/135 |
| 4,761,248 | 8/1988 | Clift | 252/527 |
| 4,834,902 | 5/1989 | Pioch et al. | 252/135 |
| 4,846,409 | 7/1989 | Kaspar et al. | 241/21 |
| 4,894,117 | 1/1990 | Bianchi et al. | 159/49 |
| 4,919,847 | 4/1990 | Barletta et al. | 252/558 |
| 4,925,585 | 5/1990 | Strauss et al. | 252/89.1 |
| 5,024,782 | 6/1991 | Finn et al. | 252/174.13 |
| 5,108,646 | 4/1992 | Beerse et al. | 252/174.25 |
| 5,133,924 | 7/1992 | Appel et al. | 264/342 |
| 5,160,657 | 11/1992 | Bortolotti et al. | 252/174.14 |
| 5,164,107 | 11/1992 | Appel et al. | 252/174 |
| 5,205,958 | 4/1993 | Swatling et al. | 252/174.13 |
| 5,366,652 | 11/1994 | Capeci et al. | 252/89.1 |

FOREIGN PATENT DOCUMENTS

| | | | |
|---|---|---|---|
| 0351937 | 1/1990 | European Pat. Off. | C11D 11/00 |
| 0451894A1 | 10/1991 | European Pat. Off. | C11D 10/04 |
| 0510746 | 10/1992 | European Pat. Off. . | |
| 0508543A1 | 10/1992 | European Pat. Off. | C11D 17/06 |
| 1517713 | 7/1978 | United Kingdom | C11D 17/06 |

OTHER PUBLICATIONS

Naviglio and Moriconi, "Detergents Manufacture," *Soap/Cosmetics/Chemical Specialties,* Sep. 1987, pp. 34–37, 54–56.

*Primary Examiner*—Paul Lieberman
*Assistant Examiner*—Lorna M. Douyon
*Attorney, Agent, or Firm*—Ken K. Patel; Jacobus C. Rasser; Jerry J. Yetter

[57] ABSTRACT

A process for preparing high density detergent agglomerates having a density of at least 650 g/l is provided. The process comprises the steps of: (a) charging a viscous surfactant paste into a mixer/densifier wherein the surfactant paste has a viscosity of from about 5,000 cps to about 100,000 cps and contains at least about 5% water; (b) adding from about 1% to about 70% of an anhydrous material into the surfactant paste just prior to entrance into the mixer/densifier to absorb at least a minor amount of the water from the surfactant paste; and (c) agglomerating the surfactant paste and the anhydrous material in the mixer/densifier so as to form detergent agglomerates having a density of at least about 650 g/l. The detergent agglomerates have high surfactant levels.

16 Claims, No Drawings

PROCESS FOR MAKING HIGH DENSITY DETERGENT AGGLOMERATES USING AN ANHYDROUS POWDER ADDITIVE

CROSS REFERENCE TO RELATED APPLICATION

This application is a continuation-in-part application of Ser. No. 08/113,572, filed Aug. 27, 1993, now U.S. Pat. No. 5,366,652.

FIELD OF THE INVENTION

The present invention generally relates to a process for producing detergent agglomerates. More particularly, the invention is directed to a process during which high density detergent agglomerates are produced using an anhydrous material which is hydratable in that it can absorb a sufficient amount of water so as to facilitate agglomeration. The process produces free flowing, high surfactant level, detergent agglomerates having a density of at least 650 g/l and are thus particularly useful in producing low dosage detergent compositions.

BACKGROUND OF THE INVENTION

Recently, there has been considerable interest within the detergent industry for laundry detergents which are "compact" and therefore, have low dosage volumes. To facilitate production of these so-called low dosage detergents, ninny attempts have been made to produce high bulk density detergents, for example with a density of 600 g/l or higher. The low dosage detergents are currently in high demand as they conserve resources and can be sold in small packages which are more convenient for consumers, especially in households where there is a premium on storage space.

Generally, there are two primary types of processes by which detergent granules or powders can be prepared. The first type of process involves spray-drying an aqueous detergent slurry in a spray-drying tower to produce highly porous detergent granules. In the second type of process, the various detergent components are dry mixed just prior to agglomeration with a binder, such as a nonionic surfactant. In the latter process in which the starting detergent materials are mixed together prior to agglomeration, there has been difficulty in producing consistent, free flowing, detergent agglomerates having the desired high density, especially when there is a high amount of binder present e.g. about 10% or higher.

The art is replete with disclosures of detergent compositions containing anhydrous materials such as carbonates and sulfates. For example, Kaminsky (commonly assigned), U.S. Pat. No. 4,487,710, discloses a granular detergent composition containing an anionic surfactant, an anhydrous material such as carbonates and sulfates, and an ethoxylated surfactant solubility aid. While the detergent composition is produced by agglomeration, it is not produced from a viscous surfactant paste, typically having a high water conical e.g. 10% or higher. In the past, there has been difficulty in producing free flowing detergent agglomerates from such a surfactant paste which has been agglomerated.

Further, there has also been difficulty in attaining high levels of surfactant in the resulting detergent agglomerates, a feature which facilitates production of low dosage detergents. More particularly, any increase in the density of granules produced by way of conventional spray drying techniques is limited by the relative amount of surfactant required to be passed through the spray drying tower. By providing a detergent agglomerate admix having a high surfactant level, the amount of surfactant passed through the spray drying tower can be reduced, thereby increasing the density of the exiting granules and ultimately the finished detergent. Thus, it would be desirable to have a process by which detergent agglomerates having higher surfactant levels can be produced.

The art is also replete with disclosures of agglomerating detergent compositions, some of which contain anhydrous materials. For example, Curtis, European patent application No. 451,894 (Unilever), discloses a process for preparing high density detergent granules by using two mixers in series. In particular, an admix of starling detergent materials are fed into a high speed mixer/densifier after which the materials are fed into a moderate speed mixer/densifier to increase the bulk density further. Thus, Curtis initially requires a high speed mixer/densifier to pulverize the detergent granules and then a second moderate speed mixer/densfier to increase the density to the desired level. Again, the Curtis process does not entail agglomerating a viscous surfactant paste.

Accordingly, despite the above-described disclosures in the art, it would be desirable to have a process for producing high density, detergent agglomerates having a density of at least 650 g/l from a viscous surfactant paste among other starting detergent components. It would also be desirable for such a process to produce detergent agglomerates having higher levels of surfactant to aid in the production of low dosage detergents and admixes therefor.

SUMMARY OF THE INVENTION

The present invention meets the aforementioned needs in the art by providing a process which produces high density, free flowing detergent agglomerates having a density of at least 650 g/l from a highly viscous surfactant paste. The process achieves the desired high density, free flowing detergent agglomerates without unnecessary process parameters, such as relatively high operating temperatures which increase manufacturing costs. The resulting high density detergent agglomerates produced by the present invention also attain high surfactant levels which facilitate use as a detergent or as a detergent admix.

As used herein, the term "agglomerates" refers to particles formed by agglomerating detergent granules or particles which typically have a smaller mean particle size than the formed agglomerates. As used herein, the phrase "at least a minor amount" of water means an amount sufficient to aid in agglomeration, typically on the order of 0.5% to about 10% by weight of the total amount of water contained in the mixture of all starting components. All percentages used herein are expressed as "percent-by-weight" unless indicated otherwise. All viscosities described herein are measured at 70° C. and at shear rates between about 10 to 50 $sec^{-1}$, preferably at 25 $sec^{-1}$.

In accordance with one aspect of the invention, a process for preparing high density detergent agglomerates is provided. The process for preparing high density detergent agglomerates comprises the steps of: (a) charging a viscous surfactant paste into a mixer/densifier wherein the surfactant paste has a viscosity of from about 5,000 cps to about 100,000 cps and contains from about 70% to 95%, by weight of said surfactant paste, of a detersive surfactant and the balance water; (b) adding from about 1% to about 70% of an anhydrous material selected from the group consisting of carbonates, sulfates, carbonate/sulfate complexes, tripolyphosphates, tetrasodium pyrophosphate, citrates, aluminosilicates, cellulose-based materials and organic synthetic polymeric absorbent gelling materials into said surfactant paste just prior to entrance into said mixer/densifier to absorb at least a minor amount of said water from said surfactant paste: and (c) agglomerating said surfactant paste and said anhydrous material by treating said surfactant paste and said anhydrous material initially in a high speed mixer/densifier and subsequently in a moderate speed mixer/densifier so as to form detergent agglomerates having a density of at least about 650 g/l.

In accordance with another aspect of the invention, another process for preparing high density detergent agglomerates is provided. The process comprises the steps of: (a) forming a viscous surfactant paste wherein the surfactant paste has a viscosity of from about 5,000 cps to about 100,000 cps and contains from about 70% to 95%, by weight of the surfactant paste, of a detersive surfactant and the balance water: (b) agglomerating the surfactant paste by treating the surfactant paste initially in a high speed mixer/densifier and subsequently in a moderate speed mixer/densifier to form detergent agglomerates; and (c) adding from about 1% to about 70% by weight of an anhydrous material selected from the group consisting of carbonates, sulfates, carbonate/sulfate complexes, tripolyphosphates, tetrasodium pyrophosphate, citrates, aluminosilicates, cellulose-based materials and organic synthetic polymeric absorbent gelling materials into said high speed mixer/densifier to absorb at least a minor amount of the water such that the detergent agglomerates are free flowing and have a density of at least about 650 g/l.

Accordingly, it is an object of the present invention to provide a process for producing high density, free flowing detergent agglomerates with a density of at least 650 g/l. It is also an object of the invention to provide a process by which such high density agglomerates can be produced from a viscous surfactant paste and other conventional detergent starting ingredients, wherein the agglomerates contain higher surfactant levels. These and other objects, features and attendant advantages of the present invention will become apparent to those skilled in the art from a reading of the following detailed description of the preferred embodiment and the appended claims.

DETAILED DESCRIPTION OF THE PREFERRED EMBODIMENT

The present invention is directed to a process which produces free flowing, high density detergent agglomerates having a density of at least 650 g/l. The process produces high density detergent agglomerates from a highly viscous surfactant paste having a relatively high water content, typically at least about 5%, to which an anhydrous material is added to absorb such water. It is the excess water in the surfactant which is believed to hinder agglomeration. Generally, the present process is used in the production of low dosage detergents whereby the resulting detergent agglomerates can be used as a detergent or as a detergent additive. In particular, the process can be used to form "high active" (i.e. high surfactant level) detergent agglomerates which are used as an admix for purposes of enhancing the active levels in granular low dosage detergents and thereby allow for more compact detergents. It should be understood that the process described herein can be continuous or batch depending upon the desired application.

Process

In the first step of the process, starting detergent materials are fed into a mixer/densifier for agglomeration. In another embodiment of the invention which is discussed more fully below, the starting detergent materials can be initially fed into a mixer or pre-mixer (e.g. a conventional screw extruder or other similar mixer) prior to agglomeration, after which the mixed detergent materials are fed into mixer/densifers as described herein for agglomeration. The anhydrous materials described herein can be added either in the extruder (pre-mixer) or in the mixer/densifier during the agglomeration step.

To achieve the desired density of 650 g/l, the agglomeration step can be carried forth initially in a high speed mixer/densifier after which a moderate speed mixer/densifier can follow, wherein the starting detergent materials are agglomerated and densified to produce particles having a density of at least 650 g/l and, more preferably from about 700 g/l to about 800 g/l. The nature and composition of the entering or starting detergent materials can vary as described in detail hereinafter. Preferably, the mean residence time of the starting detergent materials in the high speed mixer/densifier (e.g. Lodige Recycler CB30) is from about 1 to 30 seconds while the residence time in low or moderate speed mixer/densifier (e.g. Lodige Recycler KM 300 "Ploughshare") is from about 0.25 to 10 minutes. Alternatively, the agglomeration step of the process contemplates achieving the desired density of the starting detergent materials by agglomeration in a single moderate speed mixer/densifier wherein the residence time is increased, for example, up to about 15 minutes.

The starting detergent materials preferably include a highly viscous surfactant paste, the components of which are described more fully hereinafter. For purposes of facilitating agglomeration, an anhydrous material is added to the starting detergent materials including the viscous surfactant paste just prior to or, during agglomeration. In the past, agglomeration of large amounts of viscous surfactant paste having a viscosity of from about 5,000 cps to about 100,000 cps and containing at least about 5% water has resulted in detergent agglomerates which are unacceptably large, sticky and lumpy. It has now been found that the inclusion of the aforementioned anhydrous material during or just prior to agglomeration eliminates or substantially minimizes such problems.

The present process entails mixing from about 1% to about 70%, more preferably from about 5% to about 50% and, most preferably from about 5% to about 20%, by weight of an anhydrous material into the mixer/densifier to absorb at least a minor amount of the water from the surfactant paste. Thereafter, the surfactant paste, anhydrous material and other detergent materials are agglomerated in the mixer/densifier so as to form detergent agglomerates having a density of at least about 650 g/l. While not intending to be limited by theory, it is believed that the free flowing, high density detergent agglomerates produced by the present invention is attributed to the absorption of the excess water typically contained in the viscous surfactant paste by the anhydrous material during or just prior to agglomeration.

As mentioned previously, the anhydrous material can be added to the starting detergent materials prior to agglomeration. In particular, the process comprises the steps of initially forming a viscous surfactant paste to which other detergent materials as described hereinafter can be added. This, for example, can be completed in a twin-screw extruder (residence time of five seconds to 300 seconds) to insure complete mixing of the starting ingredients and provide ample residence time to complete the dehydration. The anhydrous material is then mixed into the surfactant paste in the extruder, after which the materials from the extruder are immediately and continuously fed into a mixer/densifier for agglomeration. The resulting detergent agglomerates are free flowing, have high surfactant levels and have the desired high density.

The detergent agglomerates produced by the process preferably have a surfactant level of from about 25% to about 55%, more preferably from about 35% to about 55% and, most preferably from about 45% to about 55%. Such detergent agglomerates are particularly useful in the production of low dosage detergents. The particle porosity of the resulting detergent agglomerates produced according to the process of the invention is preferably in a range from about 5% to about 20%, more preferably at about 10%. In addition, an attribute of dense or densified agglomerates is the relative particle size. The present process typically provides detergent agglomerates having a mean particle size of from about 400 microns to about 700 microns, and more preferably from about 400 microns to about 600 microns. As used herein, the phrase "mean particle size" refers to individual agglomerates and not individual particles or detergent granules. The combination of the above-referenced porosity and particle size results in agglomerates having density values of 650 g/l and higher. Such a feature is especially useful in the production of low dosage laundry detergents as well as other granular compositions such as dishwashing compositions.

Optional Process Steps

The process can comprises the step of spraying an additional binder in the mixer/densifier(s) used in the agglomeration step to facilitate production of the desired detergent agglomerates. A binder is added for purposes of enhancing agglomeration by providing a "binding" or "sticking" agent for the detergent components. The binder is preferably selected from the group consisting of water, anionic surfactants, nonionic surfactants, polyethylene glycol, polyacrylates, citric acid and mixtures thereof. Other suitable binder materials including those listed herein are described in Beerse et al, U.S. Pat. No. 5,108,646 (Procter & Gamble Co.), the disclosure of which is incorporated herein by reference.

Another optional step contemplated by the present process includes conditioning the detergent agglomerates by either drying or adding a coating agent to improve flowability after they exit the mixer/densifier(s) used in agglomeration. This furthers enhances the condition of the detergent agglomerates for use as an additive or to place them in shippable or packagable form. Those skilled in the art will appreciate that a wide variety of methods may be used to dry as well as cool the exiting detergent agglomerates without departing from the scope of the invention. By way of example, apparatus such as a fluidized bed can be used for drying while an airlift can be used for cooling should it be necessary.

Anhydrous Material

The anhydrous material used in the present process is present in an amount from about 1% to about 70%, more preferably from about 5% to about 50%, and most preferably from about 5% to about 20%. As used herein, the term "anhydrous material" means any hydratable material which is capable of absorbing water rapidly. Preferably, the anhydrous material is selected from the group consisting of carbonates, sulfates, carbonate/sulfate complexes, and mixtures thereof. While not intending to be limiting, other suitable anhydrous materials include powdered tripolyphosphate, powdered tetrasodium pyrophosphate, citrate, powdered carbonates such as calcium carbonate, powdered sulfates and mixtures thereof. Further, aluminosilicates disclosed in Corkill et al, U.S. Pat. No. 4,605,509 (Procter & Gamble), the disclosure of which is incorporated herein by reference, typically which have been overdried are suitable for use herein. Also, the anhydrous material can be selected from group consisting of absorbent gelling materials, cellulose-based materials and combinations thereof. Suitable absorbent gelling materials are disclosed in Brandt et al, U.S. Pat. Reissue No. 32,649 (commonly assigned), the disclosure of which is incorporated herein by reference. Suitable cellulose-based materials are disclosed in Herron, U.S. Pat. No. 5,183,707 and Herron et al, U.S. Pat. No. 5,137,537, the disclosures of which are incorporated by reference. Most preferably, magnesium sulfate has been found to be effective in the process described herein.

Surfactant Paste

The viscous surfactant paste used in the process has a viscosity of from about 5,000 cps to about 100,000 cps, more preferably from about 7,500 cps to about 75,000 cps, and contains at least about 5% water, more preferably at least about 10% or more water. As mentioned previously, the viscosity is measured at 70° C. and at shear rates of about 10 to 50 $sec.^{-1}$, preferably at 25 $sec.^{-1}$. Furthermore, the surfactant comprises from about 70% to about 95%, more preferably from about 75% to about 85% of a detersive surfactant, and the balance water and other conventional detergent ingredients.

The surfactant can be selected from anionic, nonionic, zwitterionic, ampholytic and cationic classes and compatible mixtures thereof. Detergent surfactants useful herein are described in U.S. Pat. No. 3,664,961, Norris, issued May 23, 1972, and in U.S. Pat. No. 3,919,678, Laughlin et al., issued Dec. 30, 1975, both of which are incorporated herein by reference. Useful cationic surfactants also include those described in U.S. Pat. No. 4,222,905, Cocktell, issued Sep. 16, 1980, and in U.S. Pat. No. 4,239,659, Murphy, issued Dec. 16, 1980, both of which are also incorporated herein by reference. Of the surfactants, anionics and nontonics are preferred and anionics are most preferred.

The following are representative examples of detergent surfactants useful in the present surfactant paste. Water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Additional anionic surfactants which suitable for use herein include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_{8-18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$ LAS.

Other anionic surfactants suitable for use herein are the sodium alkyl glyceryl ether sulfonates, especially those ethers of higher alcohols derived from tallow and coconut oil; sodium coconut oil fatty acid monoglyceride sulfonates and sulfates; sodium or potassium of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

In addition, suitable anionic surfactants include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing front about 12 to 20 carbon atoms; and beta-alkyloxy alkane sulfonates containing front about 1 to 3 carbon atoms in the alkyl group and from about 8 to 20 carbon atoms in the alkane moiety.

Preferred anionic surfactants are $C_{10-18}$ linear alkylbenzene sulfonate and $C_{10-18}$ alkyl sulfate. If desired, low moisture (less than about 25% water) alkyl sulfate paste can be the sole ingredient in the surfactant paste. Most preferred are $C_{10-18}$ alkyl sulfates, linear or branched, and any of primary, secondary or tertiary. A preferred embodiment of the present invention is wherein the surfactant paste comprises front about 20% to about 40% of a mixture of sodium $C_{10-13}$ linear alkylbenzene sulfonate and sodium $C_{12-16}$ alkyl sulfate in a weight ratio of about 2:1 to 1:2. Another preferred embodiment of the detergent composition includes a mixture of $C_{10-18}$ alkyl sulfate and $C_{10-18}$ alkyl ethoxy sulfate in a weight ratio of about 80:20.

Water-soluble nonionic surfactants are also useful in the instant invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 12 moles of ethylene oxide per mole of alkyl phenol. Included are the water-soluble and water-dispersible condensation products of aliphatic alcohols containing from 8 to 22 carbon atoms, in either straight chain or branched configuration, with from 3 to 12 moles of ethylene oxide per mole of alcohol.

An additional group of nonionics suitable for use herein are semi-polar nonionic surfactants which include water-soluble amine oxides containing one alkyl moiety of from abut 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred nonionic surfactants are of the formula $R^1(OC_2H_4)_nOH$, wherein $R^1$ is a $C_{10}$—$C_{16}$ alkyl group or a $C_8$—$C_{12}$ alkyl phenyl group, and n is from 3 to about 80. Particularly preferred are condensation products of $C_{12}$—$C_{15}$ alcohols with from about 5 to about 20 moles of ethylene oxide per mole of alcohol, e.g., $C_{12}$—$C_{13}$ alcohol condensed with about 6.5 moles of ethylene oxide per mole of alcohol.

Additional suitable nonionic surfactants include polyhydroxy fatty acid amides of the formula

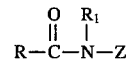

wherein R is a $C_{9-17}$ alkyl or alkenyl, $R_1$ is a methyl group and Z is glycityl derived from a reduced sugar or alkoxylated derivative thereof. Examples are N-methyl N-1-deoxyglucityl cocoamide and N-methyl N-1-deoxyglucityl oleamide. Processes for making polyhydroxy fatty acid amides are known and can be found in Wilson, U.S. Pat. No. 2,965,576 and Schwartz, U.S. Pat. No. 2,703,798, the disclosures of which are incorporated herein by reference.

Ampholylic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Cationic surfactants can also be included in the present invention. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Suitable anions are halides methyl sulfate and hydroxide. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

Cationic surfactants are often used in detergent compositions to provide fabric softening and/or antistatic benefits. Antistatic agents which provide some softening benefit and which are preferred herein are the quaternary ammonium salts described in U.S. Pat. No. 3,936,537, Baskerville, Jr. et al., issued Feb. 3, 1976, the disclosure of which is incorporated herein by reference.

Optional Detergent Components

The starting detergent ingredients of the present process can, and preferably do, also comprise a detergent builder. Builders are generally selected from the various water-soluble, alkali metal, ammonium or substituted ammonium phosphates, polyphosphates, phosphonates, polyphosphonates, carbonates, silicates, borates, polyhydroxy sulfonates, polyacetates, carboxylates, and polycarboxylates. Preferred are the alkali metal, especially sodium, salts of the above. Preferred for use herein are the phosphates, carbonates, silicates, $C_{10-18}$ fatty acids, polycarboxylates, and mixtures thereof. More preferred are sodium tripolyphosphate, tetrasodium pyrophosphate, citrate, tartrate mono- and di-succinates, sodium silicate, and mixtures thereof (see below).

Specific examples of inorganic phosphate builders are sodium and potassium tripolyphosphate, pyrophosphate, polymeric metaphosphate having a degree of polymerization of from about 6 to 21. and orthophosphates. Examples of polyphosphonate builders are the sodium and potassium salts of ethylene diphosphonic acid, the sodium and potassium salts of ethane 1-hydroxy-1, 1-diphosphonic acid and the sodium and potassium snits of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble sails of homo- and copolymers of aliphatic carboxylic acids such as maleic acid, itaconic acid, mesaconic acid, fumaric acid, aconitic acid, citraconic acid and methylenemalonic acid. Some of these materials are useful as the water-soluble anionic polymer as hereinafter described, but only if in intimate admixture with the non-soap anionic surfactant.

Other suitable polycarboxylates for use herein are the polyacetal carboxylates described in U.S. Pat. No. 4.144.226, issued Mar. 13, 1979 to Crutchfield et al, and U.S. Pat. No. 4,246,495, issued Mar. 27, 1979 to Crutchfield et al, both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, convened to the corresponding salt, and added to a detergent composition. Particularly preferred polycarboxylate builders are the ether carbonlate builder compositions comprising a combination of tartrate monosuccinate and tartrate disuccinate described in U.S. Pat. No. 4,663,071, Bush et al., issued May 5, 1987, the disclosure of which is incorporated herein by reference.

Water-soluble silicate solids represented by the formula $SiO_2.M_2O$, M being an alkali metal, and having a $SiO_2:M_2O$ weight ratio of from about 0.5 to about 4.0, are useful salts in the detergent granules of the invention at levels of from about 2% to about 15% on an anhydrous weight basis, preferably from about 3% to about 8%. Anhydrous or hydrated particulate silicate can be utilized, as well.

The starting or entering detergent components in the present process can also include any number of additional ingredients. These include other detergency builders, bleaches, bleach activators, suds boosters or suds suppressors, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and U.S. Pat. No. 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. 4,663,071, Bush et al, issued May 5, 1987, both incorporated herein by reference.

In order to make the present invention more readily understood, reference is made to the following examples, which are intended to be illustrative only and not intended to be limiting in scope.

EXAMPLE I

This Example illustrates the process of the invention which produces free flowing, high density detergent agglomerates. A batch version of the present process is described hereinafter. Initially, a surfactant paste, sodium salt of a copolymer of maleic and acrylic acid (10% by weight, hereinafter referred to as "copolymer"), anhydrous material (magnesium sulfate), and an aqueous solution containing 32% by weight of the sodium salt of ethylene diamine-N, N-disuccinic acid (hereinafter referred to as "chelant") are added to the lab-scale planetary mixer. The surfactant paste comprises an aqueous paste composition comprising 78% by weight of $C_{12.15}$ alkyl sulfate and $C_{13-15}$ alkyl ethoxy sulfate in a ratio of 80:20, and 20% water. 200 grams of a powdered builder mixture (hereinafter referenced as the "builder") comprising zeolite A and sodium carbonate in a weight ratio of 1:1 (90% by weight) is added into a lab-scale high shear mixer (Braun™). Thereafter, the surfactant paste (at 50° C.) is continuously fed into the high shear mixer/densifier at a rate of 500 g/rain until agglomerates are produced. The resulting detergent agglomerates have a density in a range from about 700 to 750 g/l and a mean particle size between about 400 to about 600 microns.

Compositions A, B, C, D, E and F are made according to the process described above and represent the composition of the starting ingredients prior to agglomeration in the high shear mixer, the relative proportions of which are presented in Table I:

TABLE I

| | % Weight | | | | | |
|---|---|---|---|---|---|---|
| | A | B | C | D | E | F |
| Surfactant Paste | 71 | 68 | 64 | 95 | 90 | 85 |
| Copolymer | 17 | 16 | 15 | — | — | — |
| Chelant | 7 | 6 | 6 | — | — | — |
| Anhydrous ($MgSO_4$) | 5 | 10 | 15 | 5 | 10 | 15 |
| | 100 | 100 | 100 | 100 | 100 | 100 |

Subsequent to agglomeration in the high shear mixer, final detergent agglomerates for each of compositions A-F are produced. The amount of surfactant ("activity") in the resulting detergent agglomerate compositions A-F for residence times in the mixer of 1 minute and 5 minutes is presented in Table II.

TABLE II

| | Surfactant Level (% weight) | | | | | |
|---|---|---|---|---|---|---|
| Residence Time | A | B | C | D | E | F |
| 1 minute | 35% | 39% | 42% | 41% | 43% | 44% |
| 5 minutes | 37% | 41% | 44% | 43% | 45% | 46% |

As can be seen from Table II, an increase in residence time in the planetary mixer has a tendency to increase the surfactant level in the final detergent agglomerates, a feature particularly useful in the production of low dosage detergents.

EXAMPLE II

This Example provides a comparison with Example I and demonstrates the reduced surfactant levels in detergent agglomerates produced by a process outside the scope of the invention. The detergent agglomerates in this Example are made by a process which does not include the step of adding an anhydrous material. In composition G, only surfactant paste is fed (500 g/min at 50° C.) into the high shear mixer which contains 200 grams of the builder mixture. In composition H, surfactant paste, copolymer and chelant are added to the high shear mixer as described in Example I. The proportions of ingredients added to the high shear mixer for compositions G and H are presented in Table III:

TABLE III

| | % Weight | |
|---|---|---|
| | G | H |
| Surfactant Paste | 100 | 75 |
| Copolymer | — | 18 |
| Chelant | — | 7 |
| | 100 | 100 |
| Surfactant level | 40% | 35% |

Starting compositions G and H are agglomerated in the high shear mixer as described in Example I to a density of from 700 to 750g/l and a mean particle size between 400 and 600 microns. As presented in Table III, the resulting detergent agglomerates have surfactant levels of 40% and 35% for the compositions G and H, respectively. These levels are considered substantially lower than the surfactant levels achieved by the detergent agglomerates made in accordance with the invention in Example I. Accordingly, the inclusion of an anhydrous material just prior to agglomeration effectively increases the surfactant level in the resulting detergent agglomerates (Example I), while omission of the step of adding an anhydrous material as described in this Example does not yield the desired higher surfactant levels in the final detergent agglomerates.

Having thus described the invention in detail, it will be obvious to those skilled in the art that various changes may be made without departing from the scope of the invention and the invention is not to be considered limited to what is described in the specification.

What is claimed is:

1. A process for preparing high density detergent agglomerates comprising the steps of:

(a) charging a viscous surfactant paste into a mixer/densifier wherein said surfactant paste has a viscosity of from about 5,000 cps to about 100,000 cps and contains from about 70% to 95%, by weight of said surfactant paste, of a detersive surfactant and the balance water;

(b) adding from about 1% to about 70% by weight of an anhydrous material selected from the group consisting of carbonates, sulfates, carbonate/sulfate complexes, tripolyphosphates, tetrasodium pyrophosphate, citrates, aluminosilicates, cellulose-based materials and organic synthetic polymeric absorbent gelling materials into said surfactant paste just prior to entrance into said mixer/densifier to absorb at least a minor amount of said water from said surfactant paste; and (c) agglomerating said surfactant paste and said anhydrous material by treating said surfactant paste and said anhydrous material initially in a high speed mixer/densifier and subsequently in a moderate speed mixer/densifier so as to form detergent agglomerates having a density of at least about 650 g/l.

2. A process according to claim 1 further comprising the step of drying said detergent agglomerates.

3. A process according to claim 1 wherein said surfactant paste comprises a surfactant selected from the group consisting of anionics, cationics, nonionics and mixtures thereof, and water.

4. A process according to claim 1 further comprising step of adding an additional binder to said mixer/densifier during said agglomerating step.

5. A process according to claim 4 wherein said additional binder is selected from the group consisting of water, anionic surfactants, nonionic surfactants, polyethylene glycol, polyacrylates, citric acid and mixtures thereof.

6. A process according to claim 1 wherein said agglomerates have a surfactant level of from about 25% to about 55% by weight.

7. A process according to claim 1 wherein said anhydrous material is selected from the group consisting of carbonates, sulfates, carbonate/sulfate complexes, and mixtures thereof.

8. A process according to claim 1 wherein said surfactant paste has a viscosity of from about 7,500 cps to about 75,000 cps.

9. A process according to claim 1 wherein said agglomerates have a mean particle size of from about 400 microns to about 600 microns.

10. A process according to claim 1 wherein said anhydrous material is selected from group consisting of organic synthetic polymeric absorbent gelling materials, cellulose-based materials and combinations thereof.

11. A process for preparing high density detergent agglomerates comprising the steps of:

(a) forming a viscous surfactant paste wherein said surfactant paste has a viscosity of from about 5,000 cps to about 100,000 cps and contains from about 70% to 95%, by weight of said surfactant paste, of a detersive surfactant and the balance water;

(b) agglomerating said surfactant paste by treating said surfactant paste initially in a high speed mixer/densifier and subsequently in a moderate speed mixer/densifier to form detergent agglomerates; and (c) adding from about 1% to about 70% by weight of an anhydrous material selected from the group consisting of carbonates, sulfates, carbonate/sulfate complexes, tripolyphosphates, tetrasodium pyrophosphate, citrates, aluminosilicates, cellulose-based materials and organic synthetic polymeric absorbent gelling materials into said high speed mixer/densifier to absorb at least a minor amount of said water such that said detergent agglomerates are free flowing and have a density of at least about 650 g/l.

12. A process according to claim 11 wherein said anhydrous material is selected from the group consisting of carbonates, sulfates, carbonate/sulfate complexes, and mixtures thereof.

13. A process according to claim 11 further comprising the step of drying said detergent agglomerates.

14. A process according to claim 11 wherein said anhydrous material is selected from group consisting of organic synthetic polymeric absorbent gelling materials, cellulose-based materials and combinations thereof.

15. A detergent product made according to the process of claim 1.

16. A detergent product made according to the process of claim 14.

* * * * *

UNITED STATES PATENT AND TRADEMARK OFFICE

CERTIFICATE OF CORRECTION

PATENT NO. : 5486,303
DATED : January 23, 1996
INVENTOR(S) : Capeci et al.

It is certified that error appears in the above-indentified patent and that said Letters Patent is hereby corrected as shown below:

In Column 1, line 30, change "ninny" to –many–.
In Column 1, line 60, change "conical" to –content–.
In Column 2, line 15, change "starling" to –starting–.
In Column 3, line 8, change "paste:" to –paste;–.
In Column 3, line 21, change "water:" to –water;–.
In Column 6, line 46, change "Cocktell" to –Cockrell–.
In Column 6, line 49, change "nontonics" to –nonionics–.
In Column 7, line 36, change "front" to –from–.
In Column 7, line 37, change "front" to –from–.
In Column 7, line 47, change "front" to –from–.
In Column 8, line 44, change "Ampholylic" to –Ampholytic–.
In Column 9, line 27, change "21." to –21,–.
In Column 9, line 31, change "snits" to –salts–.
In Column 10, line 4, change "convened" to –converted–.
In Column 10, line 7, change "carbonlate" to –carboxylate–.
In Column 10, line 67, change "$C_{12.15}$" to –$C_{12-15}$–.
In Column 11, line 7, change "g/rain" to –g/min–.

Signed and Sealed this

Tenth Day of September, 1996

*Attest:*

*Attesting Officer*

BRUCE LEHMAN

*Commissioner of Patents and Trademarks*